US005607734A

United States Patent [19]

Gonzalez

[11] Patent Number: 5,607,734

[45] Date of Patent: Mar. 4, 1997

[54] EXPANSIBLE ORNAMENT ASSEMBLY

[76] Inventor: Maureen Gonzalez, 133-46 122nd Pl., Ozone Park, N.Y. 11420

[21] Appl. No.: 416,479

[22] Filed: Apr. 4, 1995

[51] Int. Cl.[6] ..... D04D 9/00

[52] U.S. Cl. ..... 428/7; 428/9

[58] Field of Search ..... 428/7, 10, 23, 428/116, 9

[56] References Cited

U.S. PATENT DOCUMENTS

| | | | |
|---|---|---|---|
| 2,238,781 | 4/1941 | Ritter | 428/23 X |
| 2,346,824 | 4/1944 | Cohen | 428/10 |
| 2,744,348 | 5/1956 | Smith | 428/23 X |
| 3,174,894 | 3/1965 | Paige | 428/116 X |
| 4,374,877 | 2/1983 | Cole | 428/9 |
| 4,379,797 | 4/1983 | Cole | 428/9 |
| 4,826,712 | 5/1989 | Theno | 428/4 |
| 4,937,106 | 6/1990 | Eliason | 428/9 X |
| 5,026,578 | 6/1991 | Iname | 428/4 |
| 5,240,750 | 8/1993 | Cheng | 428/5 |
| 5,244,701 | 9/1993 | Saigo et al. | 428/4 |

*Primary Examiner*—Henry F. Epstein
*Attorney, Agent, or Firm*—Susan McBee

[57] ABSTRACT

An expansible ornament assembly comprising an expansible form having an open position and a closed position and constructed of a lightweight material such as tissue paper. The form has cavities formed therein and includes two ends wherein each of the two ends is attached to at least one base. The assembly includes means for attaching each base at each end thereof to a flat planar surface. When in the open position, the expansible ornament assembly is adapted to display a three dimensional object or another simulative representation such as a letter, phrase, or the like. The ornament assembly may be used in combination with a gift wrapping sheet which coordinates in some respect with the displayed three dimensional object.

13 Claims, 2 Drawing Sheets

EXPANSIBLE ORNAMENT ASSEMBLY

BACKGROUND OF THE INVENTION

1. Field of the Invention

The present invention relates to gift wrapping and in particular to an ornament assembly which expands to form an ornamental design, figure or shape which resembles either indicia which is printed on gift wrapping paper or is otherwise simulative of a 3 dimensional object.

2. Description of the Prior Art

The use of paper for wrapping gifts is known in the prior art, as is the use of ornaments or bows for decoration of a gift-wrapped object. More specifically, ornaments and bows heretofore devised and utilized for the purpose of decorating gift-wrapped objects are known to consist basically of familiar, expected, and obvious structural configurations, notwithstanding the myriad of designs encompassed by the crowded prior art which has been developed for the fulfillment of countless objectives and requirements.

By way of example, the prior art discloses various means for making and arranging various shaped bows and ribbons on packages. In particular, U.S. Pat. No. 4,374,877 to Cole discloses an automatically expanding pop-up decoration for use in connection with gift-wrapping a package having an elastic cord secured to the decoration and used to fasten the decoration to the package.

With regards to prior art disclosing various shaped bows and ribbons, U.S. Pat. No. 5,240,750 to Cheng discloses a three-dimensional, heart shaped decorative bow and a method of making the bow.

U.S. Pat. No. 5,026,578 to Iname discloses a flower shaped ribbon comprising pairs of overlapping strips with strings placed between and along the strips.

U.S. Pat. No. 4,937,106 to Eliason discloses a collapsible decorative bow assembly.

In all of the cited references, however, there has been no discussion of the paper on which the decorative items will be placed. Neither does the prior art teach the use of such decorative items in combination with wrapping paper on which there are indicia which resemble the decorative item in overall shape, color or design. The coordination between the objects, symbols or words on the wrapping paper and the decorative ornament is considered to be a main object of the invention and provides a means whereby a gift can be wrapped so that the appearance of the wrapped gift is aesthetically appealing.

Furthermore, the prior art does not teach the use of supports for maintaining the decorative ornament or bow in an upright open position. In addition, the decorative bows of the prior art are formed of a single material which significantly limits the variety of forms and shapes which are possible to create therewith. Moreover, the prior art bows contemplate only the formation of a single shape with each unit.

In this regard, the instant invention substantially departs from the conventional concepts and designs of the prior art, and in doing so provides an apparatus primarily developed for the purpose of providing an ornament or bow which expands to form an ornamental design, figure or shape resembling either indicia on wrapping paper which is included therewith or is otherwise representative of at least one 3 dimensional object. The ornament assembly further includes means for supporting supplementary indicia which may be connected therewith. Additionally, the ornament assembly may include supports which are adapted to maintain the ornament in an upright, 3-dimensional configuration.

Therefore, it can be appreciated that there exists a continuing need for a new and improved expansible ornament assembly which can be used for the purpose of providing an ornament assembly which expands to form an ornament, figure or shape resembling either the indicia on wrapping paper or another three dimensional object whereby the ornament further includes supports which serve to provide stability to the ornament in use. Furthermore, there exists a need for a gift wrapping ornament or decoration which includes both primary and supplementary indicia within the same assembly so as to form an aesthetically pleasing, personalized, or customized decoration for a special gift. In this regard, the present invention substantially fulfills this need.

SUMMARY OF THE INVENTION

In view of the foregoing disadvantages inherent in the known types of ornament assemblies now present in the prior art, the present invention provides a decorative ornament constructed of an expansible paper form of lightweight construction wherein the form may be and most preferably is simulative of an object. The expansible form preferably includes supports disposed within the form such that in use the supports serve to hold the form in a fixed configuration. Additionally, the combined ornament, in a preferred embodiment, includes secondary decorative members formed of a paper or the like which is substantially heavier than the expansible form. The decorative members are folded within the expansible form and upon opening, will extend outwardly therefrom. The combined ornament is adapted to be used in combination with a coordinated gift wrapping sheet.

As such, the general purpose of the present invention, which will be described subsequently in greater detail, is to provide a new and improved wrapping paper and ornament assembly and method which has all the advantages of the prior art and none of the disadvantages.

To attain this, the present invention in a preferred embodiment essentially comprises a decorative ornament including an expansible form of a first lightweight material comprised of tissue-paper or the like. It is contemplated that the assembly is used in combination with a sheet of paper or other material suitable for wrapping having an outer portion including first indicia. The expansible form has two ends, each of which are attached to a base having an outside face. The ornament also includes attachment means for attaching the outside face of the base to a sheet of wrapping material.

The ornament may further include one or more decorative members formed of a second material, the second material being different from and of a substantially heavier weight than the first lightweight material. The decorative members are arranged between the two ends of the expansible tissue form.

In use, the expansible form and decorative members display a primary and supplementary indicia wherein the primary and supplementary indicia resembles or coordinates with the first indicia on the outer portion of the sheet of paper. Alternatively, the expansible form and decorative members may employed without wrapping paper and as such, may be simulative of any desired 3 dimensional object or figure.

There has thus been outlined, rather broadly, the more important features of the invention in order that the detailed description thereof that follows may be better understood and in order that the present contribution to the art may be better appreciated. There are, of course, additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of descriptions and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent of legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a gift wrapping decoration which expands to form an ornament, figure or shape resembling either the indicia on wrapping paper or another three dimensional object.

It is a further object to provide a gift wrapping ornament which includes supports which serve to provide stability to the ornament in use.

Furthermore, it is another important object of the present invention to provide a gift wrapping ornament or decoration which is adapted to include both primary and supplementary indicia within the same assembly so as to form an aesthetically pleasing, personalized, or customized decoration for a special gift.

It is a further object of the present invention to provide new and improved wrapping paper and expansible ornament assembly which have all the advantages of the prior art and none of the disadvantages.

It is another object of the present invention to provide new and improved wrapping paper and expansible ornament assembly which may be easily and efficiently manufactured and marketed.

It is further object of the present invention to provide a new and improved expansible gift wrapping ornament assembly which is of durable and reliable constructions.

An even further object of the present invention is to provide a new and improved expansible gift wrapping ornament assembly which is susceptible of a low cost of manufacture with regard to both materials and labor, and which accordingly is then susceptible of low prices of sale to the consuming public, thereby making such wrapping paper and expansible ornament assemblies economically available to the buying public.

Still yet another object of the present invention is to provide a new and improved expansible ornament assembly which provide in the apparatuses and methods of the prior art some of the advantages thereof, while simultaneously overcoming some of the disadvantages normally associated therewith.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

The same reference numerals refer to the same parts through the various Figures.

DESCRIPTION OF THE PREFERRED EMBODIMENT

Reference now will be made in detail to the present preferred embodiments of the present invention, examples of which are illustrated in the accompanying drawings.

Figure 1:
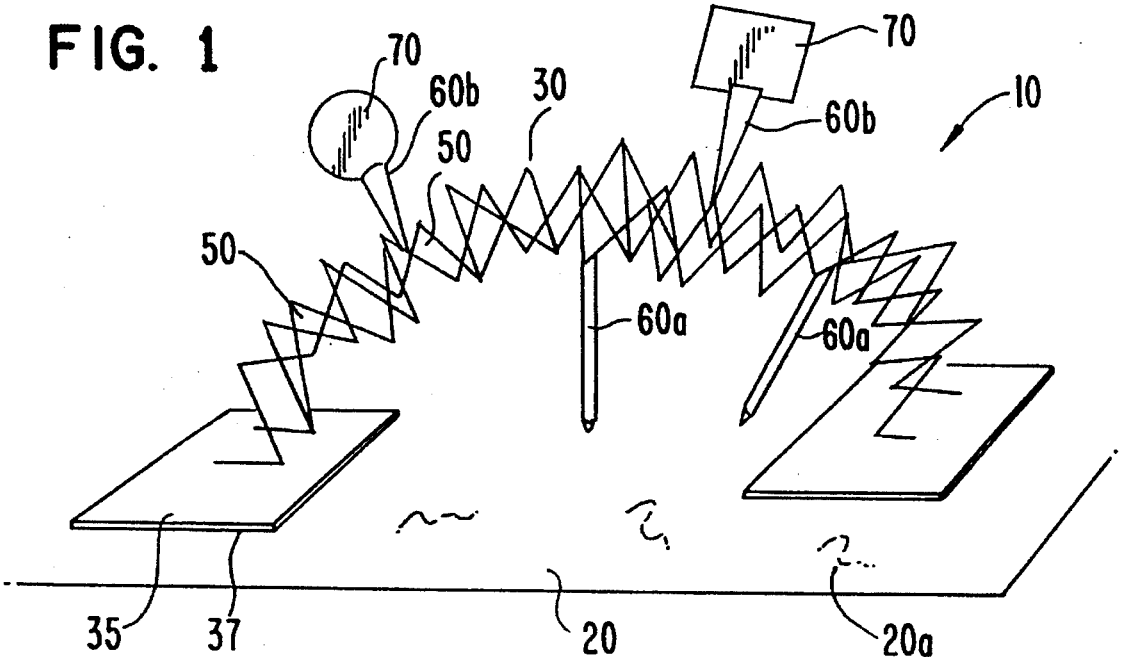
FIG. 1 is a perspective view of the preferred embodiment of the expansible ornament assembly constructed in accordance with the principles of the present invention.

The preferred embodiment of the ornament assembly is shown in FIG. 1 and generally designated by the numeral 10.

The ornament assembly 10 of the present invention is preferably used in conjunction with wrapping material 20 preferably having some sort of indicia 20*a* formed thereon. The gift wrapping material 20 is preferably any type of paper but may also be comprised of any other such suitable material, such as foil, lightweight plastic sheet material or of any other construction used by those knowledgeable in the art to provide an aesthetically appealing wrapping for a gift or similar item.

The ornament assembly itself 10 is comprised of an expansible form 30 constructed of lightweight paper such as tissue paper. Both the indicia on the paper 20*a* and the shape of the expansible form 30 may be chosen to substantially resemble or coordinate with each other in design and/or color. The configuration of the expansible form 30 may such that when expanded, the contours of the form 30 resemble various shapes or indicia such as a square, a car, an animal, a panoramic scene, a letter, words, phrases, and the like.

Figure 2A:
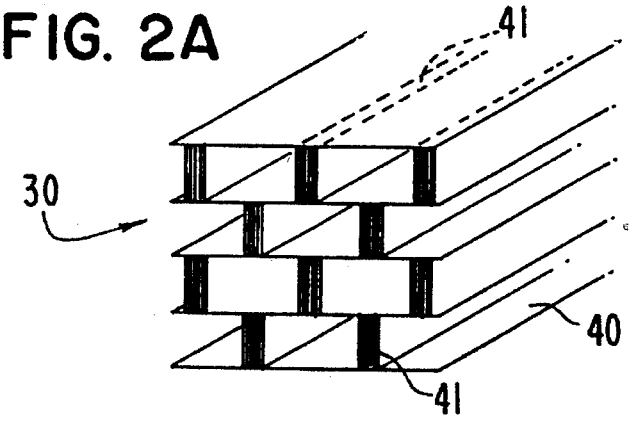
FIG. 2A is a view in partial cutaway of the expansible ornament assembly according to the present invention in a compressed state.

FIG. 2A illustrates the ornament assembly 10 of the present invention in a compressed state, prior to being expanded. The expansible form 30, made up of multiple layers of lightweight paper 40 such as tissue paper, is adhered together by means of an adhesive along adhesion lines 41. The adhesion lines 41 are generally parallel on each layer of tissue paper and serve to connect the layers of tissue paper together. It should be noted that the adhesion lines on one layer of tissue paper are offset from those on adjacent upper and lower layers of tissue paper. This arrangement serves the purpose of creating cavities 50 when the expansible tissue paper form 30 is fully expanded.

Figure 2B:
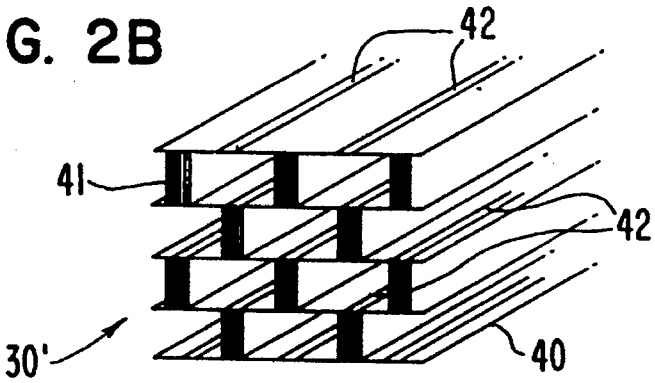
FIG. 2B is a view in partial cutaway of a second embodiment of an expansible ornament assembly according to the present invention in a compressed state.

FIG. 2B illustrates a second embodiment of the expansible tissue form 30' used in the present invention. The tissue paper layers 40' are adhered together along adhesion lines 41' in a manner substantially identical to that described by the first embodiment. The tissue paper layers of the second embodiment include metallic strips 42 adhered to the tissue paper. The strips 42 may be multi-colored and may provide additional ornamental features to the decorative ornament assembly of the present invention.

It should be noted that the expansible tissue forms of FIG. 2A and FIG. 2B may be cut in any desired shape or form so as to provide an expansible form 30,30' which, when expanded, forms indicia which resembles the indicia **20*a* provided on the wrapping paper 20. Therefore, the coordination between the indicia 20*a* on the wrapping paper 20 and the indicia of the expansible ornament assembly 30 is achieved and provides a means whereby a gift can be wrapped so that the appearance of the wrapped gift is aesthetically appealing. However, the ornament assembly 10** may be employed without wrapping paper and as such, may be simulative of any desired 3-dimensional object or figure.

Figure 4:
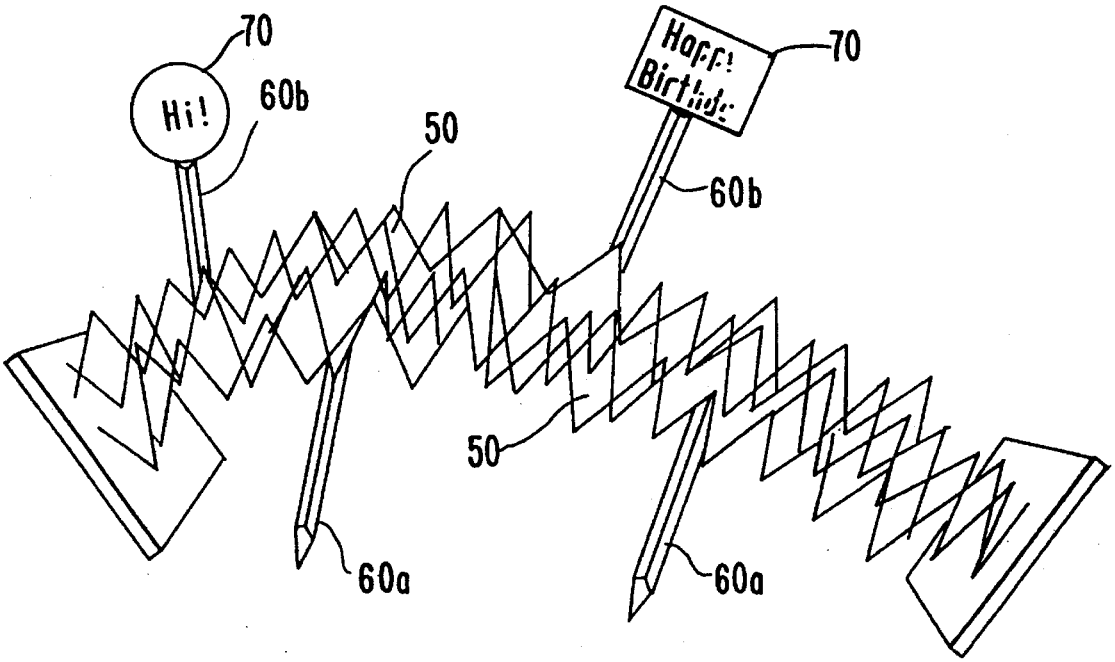
FIG. 4 is a side elevational view of the expansible ornament assembly.

As shown in FIG. 4, the expansible form 30 includes a plurality of cavities 50 when expanded. The cavities 50 are of generally quadrilateral cross section and provide recesses which retain support members **60*a*, and supplemental decorative members 60*b* which are formed of a material which is different and of heavier construction than that of the expansible form 30**.

Since the expansible form 30 is generally constructed from tissue paper and is therefore non-rigid and not self-supporting, in order to provide a means of maintaining the form in an upright and expanded configuration, support members **60*a* may be provided. The support members 60*a* comprise generally rigid longitudinal elements of cardboard or other similar material and have a quadrilateral cross-section. The quadrilateral cross-section of the support members is sized and configured such that the support members 60*a* may be inserted within the generally quadrilateral cavities 50 of the expansible form 30**.

The support members **60*a* may be secured inside the cavities 50 by means of adhesive such that when the form is compressed or unopened, the supports 60*a* are disposed completely within the confines of the recesses formed by the cavities 50. In a compressed orientation, the supports 60*a*** may be either folded or unfold depending on the shape and design of the form.

Further, in an expanded orientation, the support members **60*a* extend in a generally downward direction with respect to the wrapping paper 20 so that the ornament 10 is raised thereabove. After expansion of the form 30, the support members 60*a* may optionally be secured to the wrapping paper 20 or other surface by means of an adhesive provided on the terminal end of the members 60*a***.

Supplemental or secondary decorative members **60*b* may also be provided and are disposed within the cavities 50 of the expansible form 30 in a manner similar to that of the supports 60*a*. The supplemental decorative members 60*b* comprise generally rigid longitudinal elements of cardboard or other similar material and have a quadrilateral cross-section. The quadrilateral cross-section of the supplemental decorative members 60*b* is sized and configured such that the members 60*b* may be inserted within the generally quadrilateral cavities 50 of the expansible form 30. The supplemental decorative members 60*b* may be maintained within the cavities 50 of the form 30 in a folded or unfolded configuration. However, upon expansion of the form 30, it is to be understood that the decorative members 60*b* will extend outwardly from the form 30** so as to be visible upon casual observation.

In the event that the decorative members **60*b* and supports 60*a* are maintained in a folded orientation within the cavities 50, upon expansion of the form 30, it may be necessary for a user to manually extend both the decorative members 60*b* and supports 60*a*** outwardly or downwardly therefrom.

The supplemental decorative members **60*b* include supplemental decorations 70 which may include objects, shapes or messages intended to accompany the expansible form 30 and also possibly the wrapping paper 20. The decorations 70 resemble and/or coordinate with the shape of the expansible form 30 and also optionally with the indicia 20*a* formed on the wrapping paper if there is any. The decorations 70 provide a means for complementing the aesthetic features of the expansible form 30 and/or the wrapping paper 20** and thus allows for a fully functional decorative assembly which can be custom-designed by a user.

Figure 3:
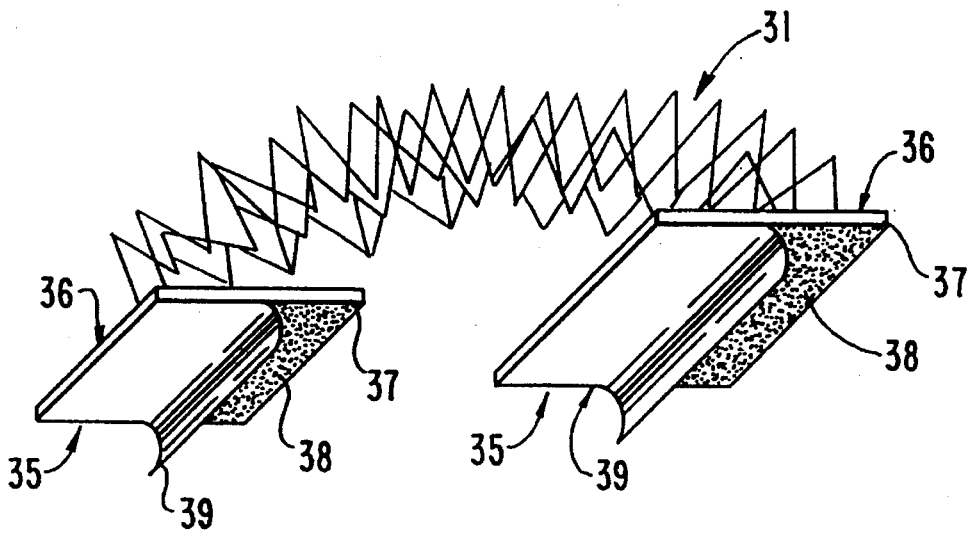
FIG. 3 is a perspective view detailing the base members of the expansible ornament assembly.

As best shown in FIG. 3, the assembly 10 includes base members 35 at each end of the expansible form 30 which provide a means for securing the assembly 10 to the wrapping paper 20 or other planar surface. The base members 35 have outside edges 37 covered with an adhesive layer 38 which permits securement of the base members 35, and thus the complete assembly 10, to the wrapping paper 20 or other surface in any position desired by the user.

Each base member 35 is constructed from cardboard, plastic, or or any other acceptable material and includes an inner side 36 and an outer side 37. The inner side 36 of each base member 35 is secured to an end of the expansible form 30 as shown in FIG. 2, by means of an adhesive. Thus, when the expansible form 30 is compressed for storage or packaging, the base members 35 sandwich the paper layers 40 of the form 30 together. This provides a compact package and by virtue of their generally rigid construction, the base members 35 provide protection to the delicate compressed paper layers 40.

On the outer side 37 of each base member 35 is a layer of adhesive 38. This adhesive layer 38 is covered by a removable foil or plastic strip 39. As shown in FIG. 1, when the foil or plastic strip is removed, the adhesive layer 38 serves to secure the base members 35 in position on the wrapping paper 20 or other surface.

The support members **60*a* and decorative members 60*b* are positioned in the cavities 50 between the base members 35 of the expansible ornament assembly 30 in such a way as to provide a secure support for both the expansible form 30 and the various object, shapes or messages 70 secured on the decorative members 60*b*. The support members 60*a* and decorative members 60*b* may be inserted between and adhered to the tissue paper layers 40 of the expansible form 30 during fabrication, thereby creating a prepared support structure for the expansible ornament assembly 10**.

Alternately, the support members 60*a* and/or the decorative members 60*b* may be provided separately to the user to be inserted into the cavities 50 after the expansion of ornament assembly 10. This latter arrangement provides the user with a means to support the expansible ornament in any position that he or she chooses, thus giving the user substantially complete choice and control over the position and design of the entire ornament assembly.

Therefore, by means of the wrapping paper 20 and combined expansible form 30, the support members 60*a*, decorative members 60*b* and various objects, shapes or messages 70, the user of the present invention is able to custom design an unlimited number of aesthetically pleasing ornamental assemblies. The user of the present invention is additionally able to personalize the outer presentation of a package by selecting an expandable ornament having an object, shape or message which appeals to the gift recipient. The user may secure various objects, shapes or messages 70 to the decorative members 60*b* secured in cavities 50 in the expansible form 30, thereby adding to the uniqueness of the wrapping presentation.

For example, an expansible form 30 with the contours of a musical note could be combined with wrapping paper 20 having musical notes as indicia 20*a* on the paper and cardboard cut-outs of musical notes as the decorations 70 on the decorative members 60*b*. In a similar manner, bright, multi-colored birthday paper could be used in conjunction with an expansible form 30 which expands out and supports a message such as "Happy Birthday." Furthermore, a wrapping paper 20 displaying a desert scene could have an expansible form 30 with the shape of a sun or a mountain wherein the decorations 70 are cactus or animal shapes or similar indicia, so as to create a desert scene.

All of these examples are meant to display the unlimited number of ways whereby the aesthetic appearance of the wrapped gift can be enhanced. The variations afforded by the present invention are extremely varied and are in a large part dependant upon the imagination of the person wrapping the gift. The invention provides for a wrapping paper and expansible ornament assembly which affords the person wrapping the gift a variety of ways to create a scene in which the wrapping paper 20, the expansible form 30 and various objects, shapes or messages 70 secured thereto inter-relate thematically with each other.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. An expansible decorative ornament assembly comprising:

a first decorative member comprising an expansible form having an open position and a closed position and constructed of a first material with cavities formed therein, said form being provided with two ends, each of said two ends being attached to at least one base at a point of attachment, each base having an outside face which is opposite to said point of attachment; and means for attaching each said base at its respective outside face to a flat planar surface; and secondary decorative members constructed of a second material, said second material being of a heavier construction than said first material, said secondary decorative members being attached to said expansible form within said cavities so that when said expansible form is in its open position, said secondary decorative members project outwardly from said expansible form;

whereby said expansible ornament in said open position is adapted to display at least one three dimensional object.

2. The expansible ornament assembly of claim 1, further comprising a sheet suitable for wrapping a gift therewith, said sheet having an outer portion including first indicia;

whereby said at least one three dimensional object resembles said first indicia on said outer portion of said sheet.

3. The expansible ornament assembly of claim 2, further comprising support means inserted into and extending outwardly from said cavities between two said ends of said expansible form.

4. The expansible ornament assembly of claim 3, wherein said support means are substantially rigid and are comprised of a plurality of longitudinal elements extending from cavities in said expansible form in a generally downward direction.

5. The expansible ornament assembly of claim 4 wherein the means for attaching each said base at each of said ends to said planar surface comprises an adhesive coating on said outside face of said base.

6. The expansible ornament assembly of claim 5 wherein a peel-off layer covers said adhesive coating on said outside face of said base.

7. The expansible ornament assembly of claim 1, wherein said expansible form has provided thereon at least one metallic strip.

8. An expansible ornament assembly of claim 1, wherein said secondary decorative members are maintained within said expansible form in a folded configuration when said form is in its closed position.

9. An expansible ornament assembly of claim 1, wherein said expansible form is formed of tissue paper.

10. An expansible ornament assembly comprising an expansible form having cavities formed therein and further being provided with two ends, each of said two ends being attached to at least one base having an outside face which has adhesive provided thereon, each of the outside faces being adhered to a surface, said ends being disposed apart from each other on said surface so that said expansible form is in an expanded orientation and projects outwardly from said surface;

decorative members which are provided within some of said cavities of said expansible form, said decorative members projecting outwardly from said form and said surface.

11. An expansible ornament assembly of claim 9, further comprising supports disposed within some of said cavities and extending downwardly from said expansible form toward said surface so as to support said expansible form in an expanded orientation above said surface.

12. An expansible ornament assembly of claim 10, wherein said expansible form forms approximately a 180° arc above said surface.

13. An expansible ornament assembly of claim 10, further comprising a wrapping sheet, said wrapping sheet covering said surface.

* * * * *